US011317195B2

(12) United States Patent
Ma et al.

(10) Patent No.: US 11,317,195 B2
(45) Date of Patent: Apr. 26, 2022

(54) MINIATURE LOUDSPEAKER MODULE

(71) Applicant: GOERTEK INC., Shandong (CN)

(72) Inventors: Hongda Ma, Shandong (CN); Guangfu Liu, Shandong (CN); Shuzhi Zhou, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 17/058,786

(22) PCT Filed: Dec. 29, 2018

(86) PCT No.: PCT/CN2018/125335
§ 371 (c)(1),
(2) Date: Nov. 25, 2020

(87) PCT Pub. No.: WO2019/227924
PCT Pub. Date: Dec. 5, 2019

(65) Prior Publication Data

US 2021/0204055 A1 Jul. 1, 2021

(30) Foreign Application Priority Data

May 28, 2018 (CN) ..... 201810525244.X

(51) Int. Cl.
*H04R 1/28* (2006.01)
*H04R 9/02* (2006.01)
(Continued)

(52) U.S. Cl.
CPC ..... *H04R 1/2826* (2013.01); *H04R 1/021* (2013.01); *H04R 1/025* (2013.01); *H04R 1/2803* (2013.01);
(Continued)

(58) Field of Classification Search
CPC ..... H04R 1/021; H04R 1/025; H04R 1/2803; H04R 1/2807; H04R 1/2826;
(Continued)

(56) References Cited

U.S. PATENT DOCUMENTS 10,264,335 B1 * 4/2019 Ren ..... H04R 1/02
2014/0177902 A1 6/2014 Yeh
(Continued)

FOREIGN PATENT DOCUMENTS

CN 103957487 A 7/2014
CN 205726407 U 11/2016
(Continued)

*Primary Examiner* — Huyen D Le
(74) *Attorney, Agent, or Firm* — Baker Botts, LLP

(57) ABSTRACT

Disclosed is a miniature speaker module. The module includes: a module housing and a speaker unit, wherein the speaker unit divides an inner space of the module housing into a front sound cavity and a rear sound cavity. The module housing includes a side wall and a bottom wall connected to the side wall, in which side wall being provided a sound outlet hole. The module housing further includes a supporting platform arranged in a cavity enclosed by the side wall and the bottom wall, and a partition wall connected to the supporting platform, wherein the partition wall and the bottom wall are parallel and oppositely arranged one above another. The speaker unit is mounted on the supporting platform. The speaker unit, the supporting platform and the partition wall constitute the front sound cavity, wherein the front sound cavity is in communication with the sound outlet hole.

12 Claims, 3 Drawing Sheets

(51) Int. Cl.
*H04R 9/06* (2006.01)
*H04R 1/02* (2006.01)

(52) U.S. Cl.
CPC ..... *H04R 1/2842* (2013.01); *H04R 9/02* (2013.01); *H04R 9/06* (2013.01); *H04R 2400/11* (2013.01); *H04R 2499/11* (2013.01)

(58) Field of Classification Search
CPC ..... H04R 1/2842; H04R 1/2869; H04R 9/02; H04R 9/06; H04R 2400/11; H04R 2499/11; H04R 2499/15
See application file for complete search history.

(56) References Cited

U.S. PATENT DOCUMENTS

| | | | | |
|---|---|---|---|---|
| 2016/0295316 | A1* | 10/2016 | Shao | H04R 1/2857 |
| 2017/0070796 | A1* | 3/2017 | Miao | H04R 1/025 |

FOREIGN PATENT DOCUMENTS

| | | | |
|---|---|---|---|
| CN | 205987287 | U | 2/2017 |
| CN | 106714047 | A | 5/2017 |
| CN | 206821001 | U | 12/2017 |
| CN | 108551635 | A | 9/2018 |

* cited by examiner

MINIATURE LOUDSPEAKER MODULE

CROSS-REFERENCE TO RELATED APPLICATIONS

This application is a National Stage of International Application No. PCT/CN2018/125335, filed on Dec. 29, 2018, which claims priority to Chinese Patent Application No. 201810525244.X, filed on May 28, 2018, both of which are hereby incorporated by reference in their entireties.

TECHNICAL FIELD

The present disclosure relates to the field of an electroacoustic technology, and more particularly, to a miniature speaker module.

BACKGROUND

A miniature speaker module is an important acoustic component of a portable electronic device, is a device configured to realize the conversion between an electrical signal and an acoustic signal, and is often used in an electronic device such as a mobile phone or a computer. A prior art miniature speaker module usually includes a housing to accommodate a speaker unit by which the module is divided into two cavities, a front sound cavity and a rear sound cavity.

At present, with the increasingly reduced size of the miniature speaker, a volume of a cavity in a miniature speaker module is also getting smaller and smaller. How to make full use of space in the housing of the miniature speaker module has become an important factor which influences the sound quality of the miniature speaker.

In the prior art, a module housing is sufficient in height, but suffers from more restrictions in width and length directions. As such, part of a sound cavity of the miniature speaker is difficult to be fully utilized, resulting in waste of the sound cavity.

Therefore, it is necessary to propose a novel miniature speaker module to overcome the above-mentioned defects.

SUMMARY

An objective of the present disclosure is to provide a new technical solution of a miniature speaker module.

According to a first aspect of the present disclosure, there is provided a miniature speaker module, which includes a module housing and a speaker unit, wherein the speaker unit divides an inner space of the module housing into a front sound cavity and a rear sound cavity;

the module housing includes a side wall and a bottom wall connected to the side wall, in which side wall being provided a sound outlet hole; the module housing further includes a supporting platform arranged in a cavity enclosed by the side wall and the bottom wall, and a partition wall connected to the supporting platform, wherein the partition wall and the bottom wall are parallel and oppositely arranged one above another;

the speaker unit is mounted on the supporting platform; the speaker unit, the supporting platform and the partition wall constitute the front sound cavity, and the front sound cavity is in communication with the sound outlet hole; and a first cavity is formed as a space between the supporting platform and the partition wall on one hand and the bottom wall and the side wall on the other hand, wherein the first cavity is a part of the rear sound cavity.

Optionally, an air flow channel communicating the inside and outside of the first cavity is formed between the supporting platform and the side wall, and is encapsulated with mesh cloth.

Optionally, the supporting platform surrounds the partition wall; a side of the supporting platform away from the partition wall extends upward to form a supporting wall; ports of the air flow channel are formed between the supporting wall and the side wall; and the mesh cloth is arranged on the ports.

Optionally, two ports are provided and located on two sides of the speaker unit.

Optionally, the first cavity is filled with sound-absorbing particles.

Optionally, the partition wall is of a plastic structure integrated with the supporting platform by injection molding;

or the partition wall is a metal sheet injected as an insert on the supporting platform.

Optionally, the bottom wall is provided with a filling hole thereon.

Optionally, the sound outlet hole horizontally leads to the front sound cavity.

Optionally, the module housing comprises a first housing and a second housing, wherein the first housing comprises the side wall, the supporting platform, the partition wall and the bottom wall; the second housing is buckled on the first housing; a second cavity which is in communication with the first cavity is formed between the second housing, the first housing and the speaker unit; and the first cavity and the second cavity jointly constitute the rear sound cavity.

Optionally, a volume of the first cavity is greater than that of the second cavity.

Optionally, the bottom wall is ultrasonically or adhesively fixed to the side wall.

A technical effect of the present disclosure lies in that: by improving the internal structure of the speaker module housing and adjusting the position of the speaker unit, an excess space in the module housing is converted into a rear sound cavity, thereby increasing the volume of the rear sound cavity, and significantly promoting the acoustic performance of the miniature speaker.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings herein which are incorporated into and constitute a part of the description, illustrate the embodiments according to the present disclosure, and serve as explaining the principles of the present disclosure together with the description.

DETAILED DESCRIPTION

Figure 1:
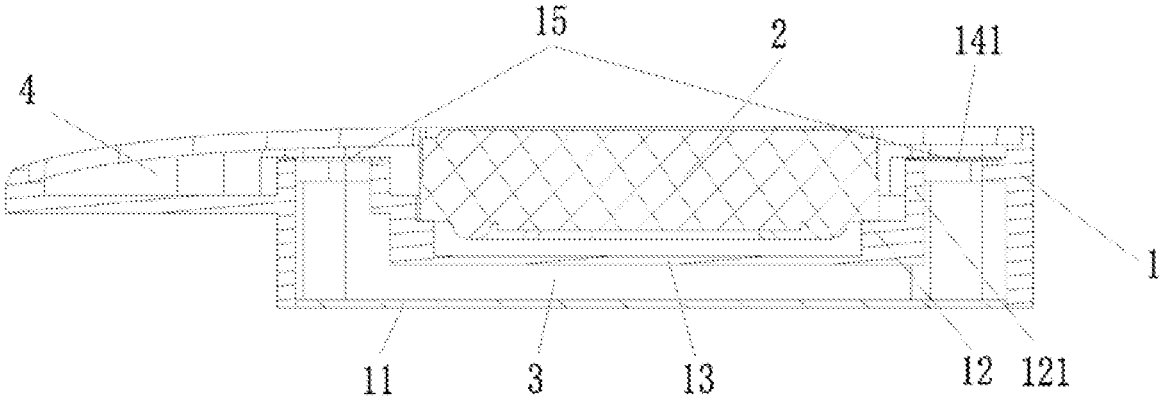
FIG. 1 is a schematic structural view of a miniature speaker module provided by a specific embodiment of the present disclosure.

Various exemplary embodiments of the present disclosure will now be described in detail with reference to the accompanying drawings. It should be noted that the relative arrangement, numerical expressions and numerical values of the components and steps set forth in these embodiments do not limit the scope of the present disclosure unless otherwise specified.

The following description of at least one exemplary embodiment is in fact merely illustrative and is in no way intended as a limitation to the present disclosure and its application or use.

Techniques, methods, and devices known to those of ordinary skill in the relevant art may not be discussed in detail but where appropriate, the techniques, methods, and devices should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, there is no need for further discussion in the accompanying drawings.

Figure 2:
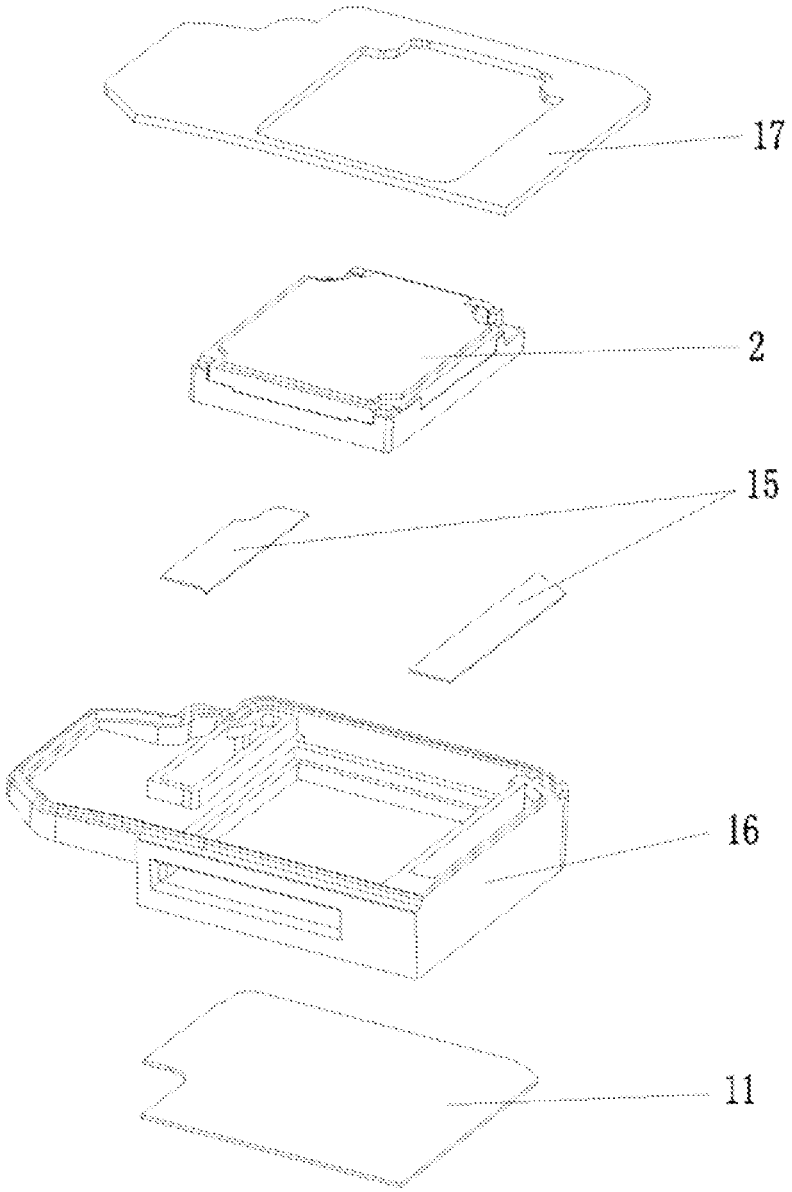
FIG. 2 is an exploded view of a miniature speaker module provided by a specific embodiment of the present disclosure.
Figure 3:
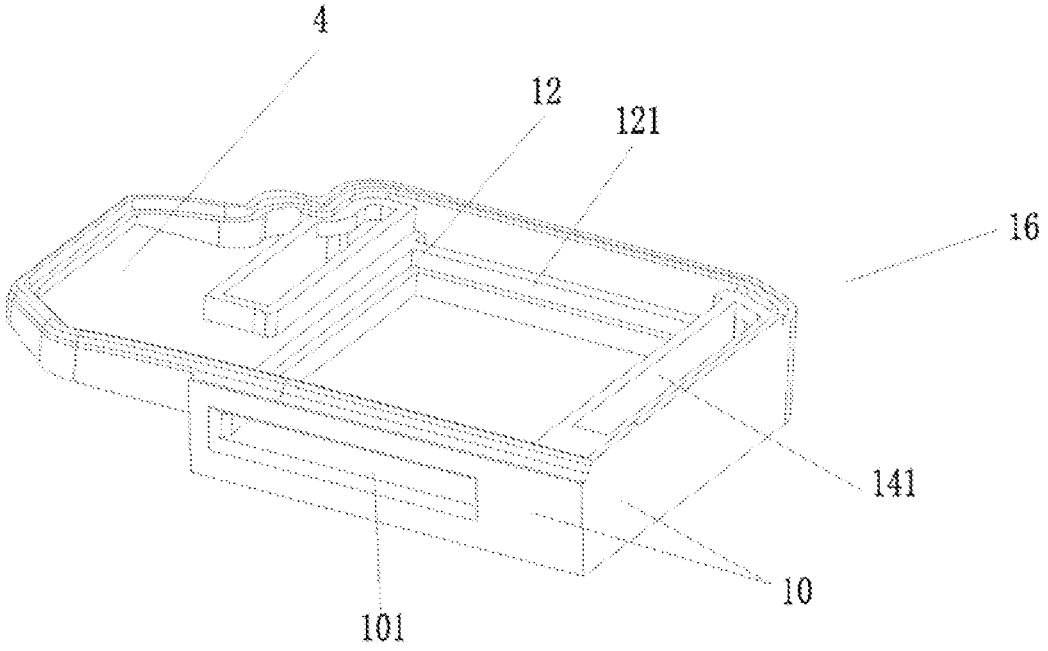
FIG. 3 is a schematic structural view of an upper module housing provided by a specific embodiment of the present disclosure.
Figure 4:
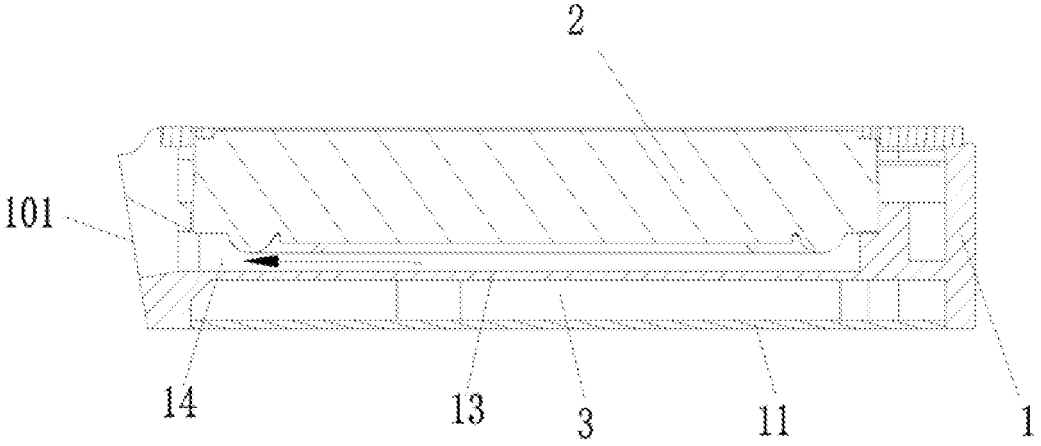
FIG. 4 is a sectional view of a miniature speaker module provided by a specific embodiment of the present disclosure.

The present disclosure provides a novel miniature speaker module, which can be assembled in a mobile terminal such as a mobile phone or a computer. FIG. 1 illustrates a schematic structural view of the miniature speaker module. In FIGS. 2 to 4, the structure and principle of the miniature speaker module of the present disclosure are described in detail, taking the structure of the miniature speaker module as an example.

The present disclosure provides a miniature speaker module, which includes a module housing 1 and a speaker unit 2, wherein the speaker unit 2 divides an inner space of the module housing 1 into a front sound cavity and a rear sound cavity. The module housing 1 includes: a side wall 10; and a bottom wall 11 connected to the side wall 10. A sound outlet hole 101 is provided in the side wall 10. The module housing 1 further includes a supporting platform 12 arranged in a cavity enclosed by the side wall 10 and the bottom wall 11, and a partition wall 13 connected to the supporting platform 12, wherein the partition wall 13 and the bottom wall 11 are parallel and oppositely arranged one above another.

As shown in FIG. 1 and FIG. 3, the speaker unit 2 is mounted on the supporting platform 12. The speaker unit 2, the supporting platform 12 and the partition wall 13 constitute the front sound cavity, and the front sound cavity is in communication with the sound outlet hole 101. A first cavity 3 is formed as a space between the supporting platform 12 and the partition wall 13 on one hand and the bottom wall 11 and the side wall 10 on the other hand, wherein the first cavity 3 is a part of the rear sound cavity.

In an optional implementation of the present disclosure, the front sound cavity and the first cavity are sequentially stacked below the speaker unit in a thickness direction of the speaker module. In this way, a space in the speaker module is fully utilized in the height direction. A part of the front sound cavity and the rear sound cavity are arranged below the speaker unit, solving the problem of spatial angle limitation of the speaker module in a width or length direction.

According to the miniature speaker module provided by the present disclosure, by improving the internal structure of the speaker module housing and adjusting the position of the speaker unit, an excess space in the module housing is converted into the rear sound cavity, thereby increasing the volume of the rear sound cavity, and significantly promoting the acoustic performance of the miniature speaker.

Optionally, an air flow channel 14 communicating the inside and outside of the first cavity 3 is formed between the supporting platform 12 and the side wall 10, and is encapsulated with mesh cloth 15.

Specifically, the supporting platform 12 surrounds the partition wall 13. A side of the supporting platform 12 away from the partition wall 13 extends upward to form a supporting wall 121. Ports 141 of the air flow channel 14 are formed between the supporting wall 121 and the side wall 10. The mesh cloth 15 is arranged on the ports 141. The mesh cloth can absorb sound energy by changing the air permeability to influence the vibration of a vibrating plate, thereby influencing the frequency response of the speaker. Those skilled in the art can select mesh cloth with different acoustic resistances as needed, to achieve better acoustic performance of the miniature speaker. In addition, the mesh cloth can be arranged on the air flow channel through processes such as hot melting, injection molding, laser welding or bonding, which will not be limited in this embodiment.

As shown in FIG. 1 and FIG. 3, the supporting platform 12 provided in this embodiment is in a stepped shape, and used to fix the speaker unit 2. The front sound cavity and the first cavity are spaced apart by the partition wall 13 on a lower side of the supporting platform 12. The supporting wall 121, which is formed by extending a side away from the partition wall 13 upward, together with the side wall 10 to form the ports 141 of the air flow channel 14. The two ports 141 are located at both sides of the speaker unit 2 respectively.

In an optional implementation, the partition wall 13 is of a plastic structure integrated with the supporting platform 12 by injection molding. The structure where the partition wall 13 and the support platform 12 are integrally formed has a better scaling performance.

In another possible implementation, the partition wall 13 is a metal sheet which is injection molded as an insert on the supporting platform 12. By means of an injection-molded metal sheet, the thickness of the partition wall is reduced, and the volume of the first cavity can be further enlarged.

Since the first cavity is a part of the rear sound cavity, the rear sound cavity has a significant influence on the acoustic performance of the speaker module. In order to enable the speaker module with good performances, reduce the resonant frequency of the module and improve the sound quality of the miniature speaker, those skilled in the art may also fill the first cavity with sound-absorbing particles. The sound-absorbing particles can increase pore structures, which can partially absorb the sound energy, such that stronger air compression and release ability is achieved, and a virtual space is enlarged, which is equivalent to expanding the volume of the sound cavity, thereby achieving the effect of reducing the resonance frequency of the module.

In addition, since the front sound cavity and the first cavity are respectively located below the speaker unit, when the first cavity is filled with the sound-absorbing particles, heat generated by the speaker unit will not directly impact the module housing and the bottom. The sound-absorbing material can effectively relieve the impact of the heat on the module housing.

As shown in FIG. 3 and FIG. 4, the sound outlet hole 101 horizontally leads to the front sound cavity. The air flow in the front sound cavity leads to the sound outlet hole 101 along the air flow channel 14. Such a sound outlet channel is smoother than the traditional sound outlet channel. Meanwhile, the impact between the sound and the module housing in a tortuous sound outlet channel is also reduced, and the acoustic performance of the speaker module is improved.

Optionally, the module housing 1 includes a first housing 16 and a second housing 17. The first housing 16 comprises the side wall 10, the supporting platform 12, the partition wall 13 and the bottom wall 11. As shown in FIG. 1 and FIG. 2, the second housing 17 is buckled on the first housing 16. A second cavity 4 which is in communication with the first cavity 3 is formed between the second housing 17, the first housing 16 and the speaker unit 2;

It should be noted that, in the field of a speaker technology, the front sound cavity and the rear sound cavity divide different areas of the speaker module from the perspective of influencing low-frequency and high-frequency performances of the sound. The concepts of "first cavity" and "second cavity" involved in this embodiment are divided from the perspective of the structure of the speaker module.

In the case that the structural space of the miniature speaker module is limited, those skilled in the art can adjust the structural shape of the second cavity 3 as required. In this embodiment, the volume of the first cavity 3 is greater than that of the second cavity 4. The first cavity 3 and the second cavity 4 jointly constitute the rear sound cavity of the miniature speaker module, which can significantly improve the acoustic performance of the miniature speaker in a low frequency bands.

Further, as shown in FIG. 2, a bottom wall 11 is provided below the first housing 16. The bottom wall 11 can be fixed on the side wall 10 by ultrasonic welding or bonding. For example, the bottom wall 11 may be a steel sheet sealed on the side wall 10. The type and a sealing method of the bottom wall are not limited in this embodiment. A filling hole (not shown in FIG. 2) is also provided in the bottom wall 11 to facilitate the filling of the sound-absorbing particles in the first cavity.

Compared with conventional miniature speaker modules, the miniature speaker module provided by in this embodiment is characterized in that: by changing the structure of the module housing and adjusting the position of the speaker unit, the rest of the space in the module housing is converted into the first cavity filled with the sound-absorbing particles. The cavity functions as a part of the rear sound cavity and increases the volume of the rear sound cavity, expedites low-frequency characteristics of the miniature speaker and improve the sound quality of the miniature speaker. The filled sound-absorbing particles can also further improve the acoustic performance of the speaker module.

While certain specific embodiments of the present disclosure have been illustrated by way of example, it will be understood by those skilled in the art that the foregoing examples are provided for the purpose of illustration and are not intended to limit the scope of the present disclosure. It will be understood by those skilled in the art that the foregoing embodiments may be modified without departing from the scope and spirit of the present disclosure. The scope of the present disclosure is subject to the attached claims.

The invention claimed is:

1. A miniature speaker module, comprising a module housing and a speaker unit, wherein the speaker unit divides an inner space of the module housing into a front sound cavity and a rear sound cavity:

the module housing comprises a side wall and a bottom wall connected to the side wall, the side wall having a sound outlet hole; the module housing further comprises a supporting platform arranged in a cavity enclosed by the side wall and the bottom wall, and a partition wall connected to the supporting platform, wherein the partition wall and the bottom wall are parallel and oppositely arranged;

the speaker unit is mounted on the supporting platform; the speaker unit, the supporting platform and the partition wall forming the front sound cavity, and wherein the front sound cavity is in communication with the sound outlet hole; and a first cavity is formed as a space between the supporting platform and the partition wall on a first side and the bottom wall and the side wall on a second side, wherein the first cavity is formed as a part of the rear sound cavity, wherein an air flow channel communicating the inside and outside of the first cavity is formed between the supporting platform and the side wall, and is encapsulated with a mesh cloth.

2. The miniature speaker module according to claim 1, wherein the supporting platform surrounds the partition wall; a side of the supporting platform away from the partition wall extends upward to form a supporting wall; ports of the air flow channel are formed between the supporting wall and the side wall; and the mesh cloth is arranged on the ports.

3. The miniature speaker module according to claim 2, wherein two ports are provided and located on two sides of the speaker unit.

4. The miniature speaker module according to claim 1, wherein the first cavity is filled with sound-absorbing particles.

5. The miniature speaker module according to claim 1, wherein the partition wall is of a plastic structure integrated with the supporting platform by injection molding.

6. The miniature speaker module according to claim 1, wherein the bottom wall is provided with a filling hole thereon.

7. The miniature speaker module according to claim 1, wherein the sound outlet hole horizontally leads to the front sound cavity.

8. The miniature speaker module according to claim 1, wherein the module housing comprises a first housing and a second housing;

the first housing comprises the side wall, the supporting platform, the partition wall and the bottom wall;

the second housing is buckled on the first housing;

a second cavity which is in communication with the first cavity is formed between the second housing, the first housing and the speaker unit; and the first cavity and the second cavity jointly constitute the rear sound cavity.

9. The miniature speaker module according to claim 8, wherein a volume of the first cavity is greater than that of the second cavity.

10. The miniature speaker module according to claim 1, wherein the bottom wall is ultrasonically fixed to the side wall.

11. The miniature speaker module according to claim 1, wherein the bottom wall is adhesively fixed to the side wall.

12. The miniature speaker module according to claim 1, wherein the partition wall is a metal sheet injected as an insert on the supporting platform.

* * * * *